US007641244B2

(12) United States Patent
Lin

(10) Patent No.: US 7,641,244 B2
(45) Date of Patent: Jan. 5, 2010

(54) FIRE DOOR LOCK

(75) Inventor: Ching-Tien Lin, Hsin Chuang (TW)

(73) Assignee: Thase Enterprise Co., Ltd., Taipei Hsien (TW)

( * ) Notice: Subject to any disclaimer, the term of this patent is extended or adjusted under 35 U.S.C. 154(b) by 175 days.

(21) Appl. No.: 11/877,677

(22) Filed: Oct. 24, 2007

(65) Prior Publication Data

US 2009/0107189 A1 Apr. 30, 2009

(51) Int. Cl.
*E05B 65/10* (2006.01)

(52) U.S. Cl. ..... 292/92

(58) Field of Classification Search ..... 292/92, 292/DIG. 65, DIG. 66, 4–6, 56–67, 70, 71, 292/194, 214–218, 93, 94; 70/92
See application file for complete search history.

(56) References Cited

U.S. PATENT DOCUMENTS 5,219,385 A * 6/1993 Yeh ..... 70/92
5,890,752 A * 4/1999 Lin ..... 292/92
6,009,732 A * 1/2000 Haeck et al. ..... 70/92
6,205,825 B1 * 3/2001 Haeck et al. ..... 70/92
6,532,777 B2 * 3/2003 Haeck et al. ..... 70/92
6,619,704 B1 * 9/2003 Lee ..... 292/93
6,820,905 B1 * 11/2004 Haeck et al. ..... 292/93
6,945,571 B2 * 9/2005 Lin ..... 292/92
7,070,210 B2 * 7/2006 Lin ..... 292/93
7,469,942 B2 * 12/2008 Whitaker et al. ..... 292/92
7,536,885 B1 * 5/2009 Ross et al. ..... 70/92
2004/0183311 A1 * 9/2004 Lin ..... 292/92
2004/0227351 A1 * 11/2004 Lin ..... 292/92

* cited by examiner

*Primary Examiner*—Peter Cuomo
*Assistant Examiner*—Mark Williams
(74) *Attorney, Agent, or Firm*—Leong C. Lei

(57) ABSTRACT

A fire door lock includes a base assembly including first and second slide blocks, a locking control assembly including a movable seat forming a groove and a tongue control plate movably mounted to one side of the locking control assembly, and a winglet assembly including first and second winglets both having a boss movably received in the groove of the movable seat and both being respectively and rotatably coupled to the first and second slide blocks. Thus, when the movable seat is driven by a handle, the movable seat moves the first and second slide blocks to withdraw first and second latch bars to unlock the fire door and when the fire door is closed, the tongue control plate is actuated to allow the movable seat to return to the locked condition and the first and second latches and a tongue are stretched out to realize three-directional locking.

4 Claims, 13 Drawing Sheets

FIRE DOOR LOCK

BACKGROUND OF THE INVENTION (a) Technical Field of the Invention

The present invention relates to a fire door lock, and in particular to a fire door lock comprising a movable seat, which when actuated and moved by a handle bar, moves first and second slide blocks and a lock tongue inward to further drive first and second latch bars inwards to unlock the fire door, and which, when the door is closed and a tongue control plate is brought into contact with an external fixture and thus actuated, automatically returns to the original locked position to stretch the first and second latch bars outward to secure the fire door and also cause a tongue holder seat to abut against and maintain the tongue in the locked condition thereby realizing a three-directional locking of the fire door.

(b) Description of the Prior Art

Fire door locking mechanisms are known, such as Taiwan Patent Publication No. 568161, which discloses in FIG. 11 of the attached drawings thereof a central locking mechanism 3 and upper and lower locking mechanisms 4, 6 that are coupled to the central locking mechanism 3, and a transmission mechanism 9 that is coupled to the central locking mechanism 3 so that when an operating handle bar is depressed, the transmission mechanism 9 drives the central locking mechanism 3, which in turn drives the upper and lower locking mechanisms 4, 6 to operate in a simultaneous manner for locking and unlocking a fire door.

The conventional device, although effective in overcoming the drawback of other known fire door mechanism that no upper and lower vertical latching are included. However, such a conventional device does not include horizontal latching or locking so that when the fire door can be broken in by breaking a middle portion of the door. Thus, further improvement is needed.

Other prior art references, such as U.S. Pat. No. 7,144,050, suffer the same drawback.

Thus, it is desired to provide an improved fire door lock that enhances security of the fire door, while maintaining easy operation by a user to open the door.

SUMMARY OF THE INVENTION

The primary purpose of the present invention is to provide a fire door lock comprising a base assembly, which comprises a bottom plate on which first and second slide blocks are slidably mounted, a locking control assembly, which comprises a movable seat forming a groove and a tongue control plate movably mounted to one side of the locking control assembly, and a winglet assembly, which comprises first and second winglets, which both have a boss movably received in the groove of the movable seat and both being respectively and rotatably coupled to the first and second slide blocks. Thus, when the movable seat is driven by an operating handle bar, the movable seat is driven to move the first and second slide blocks to withdraw first and second latch bars to thereby unlock the fire door. When the fire door is closed, the tongue control plate is hit and acted to allow the movable seat to return to the locked condition and the first and second latches and a tongue are stretched out to realize three-directional locking.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
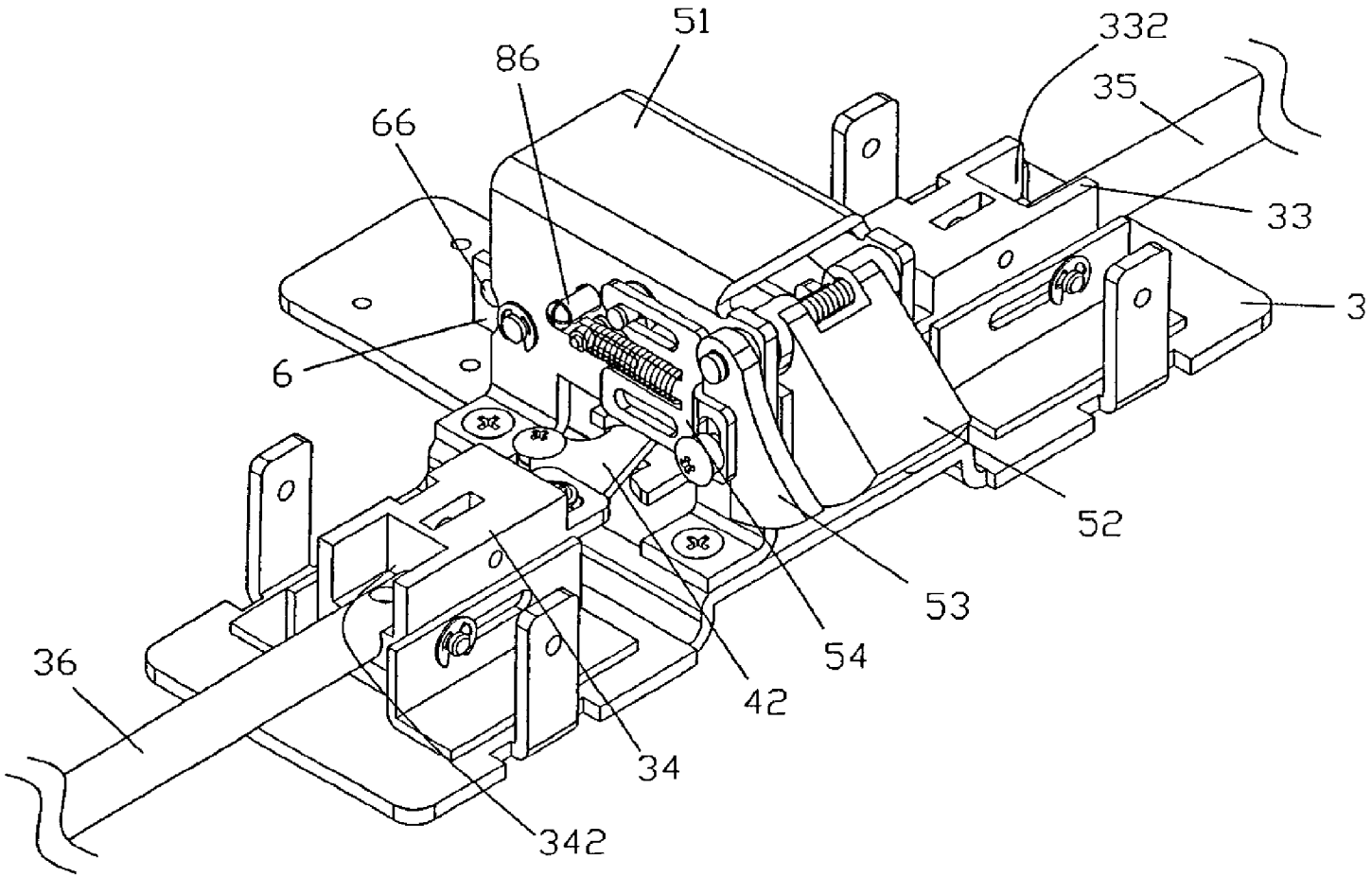
FIG. 1 is a perspective view showing a fire door lock constructed in accordance with the present invention.
Figure 2:
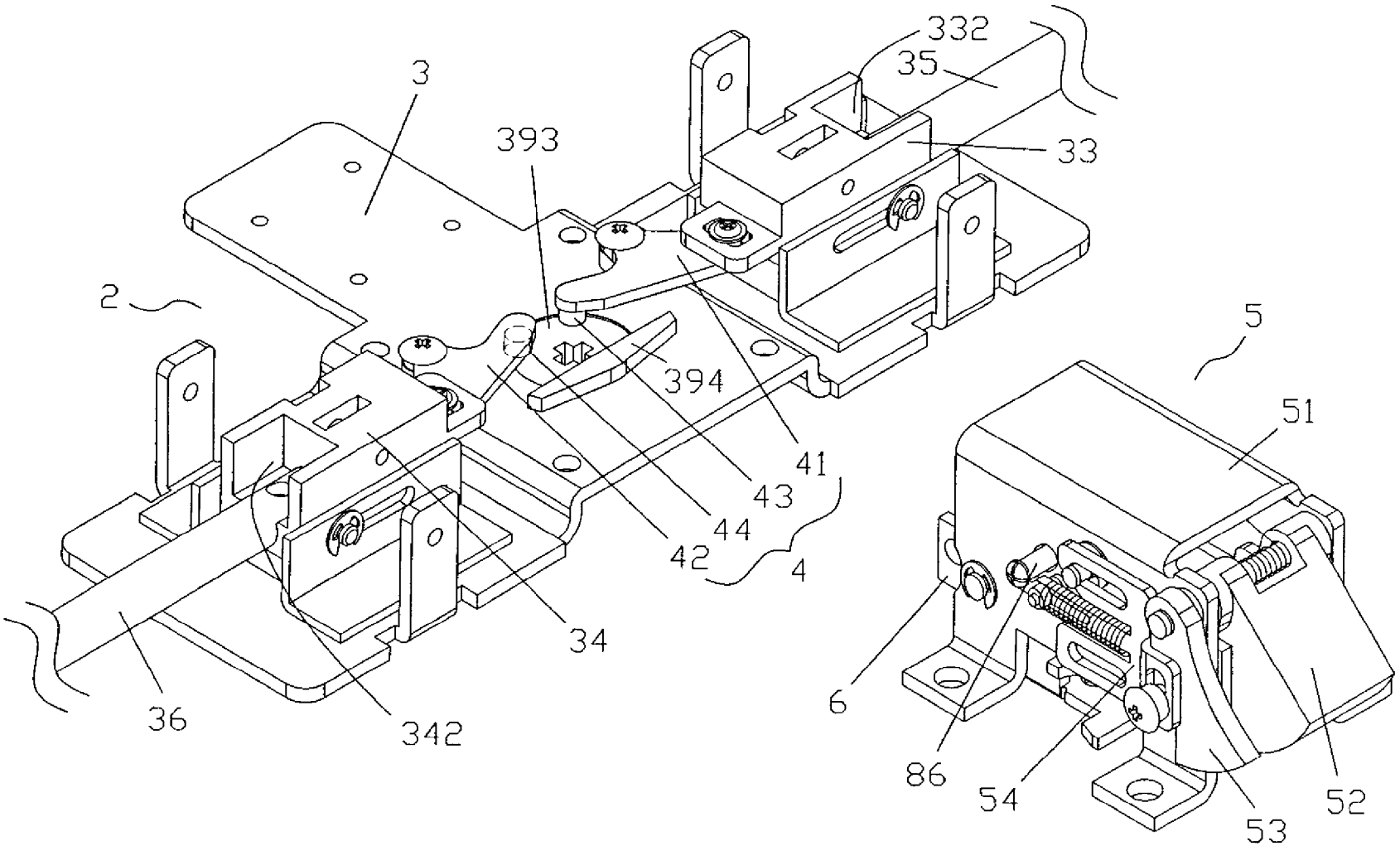
FIG. 2 is an exploded view of the fire door lock of the present invention.
Figure 3:
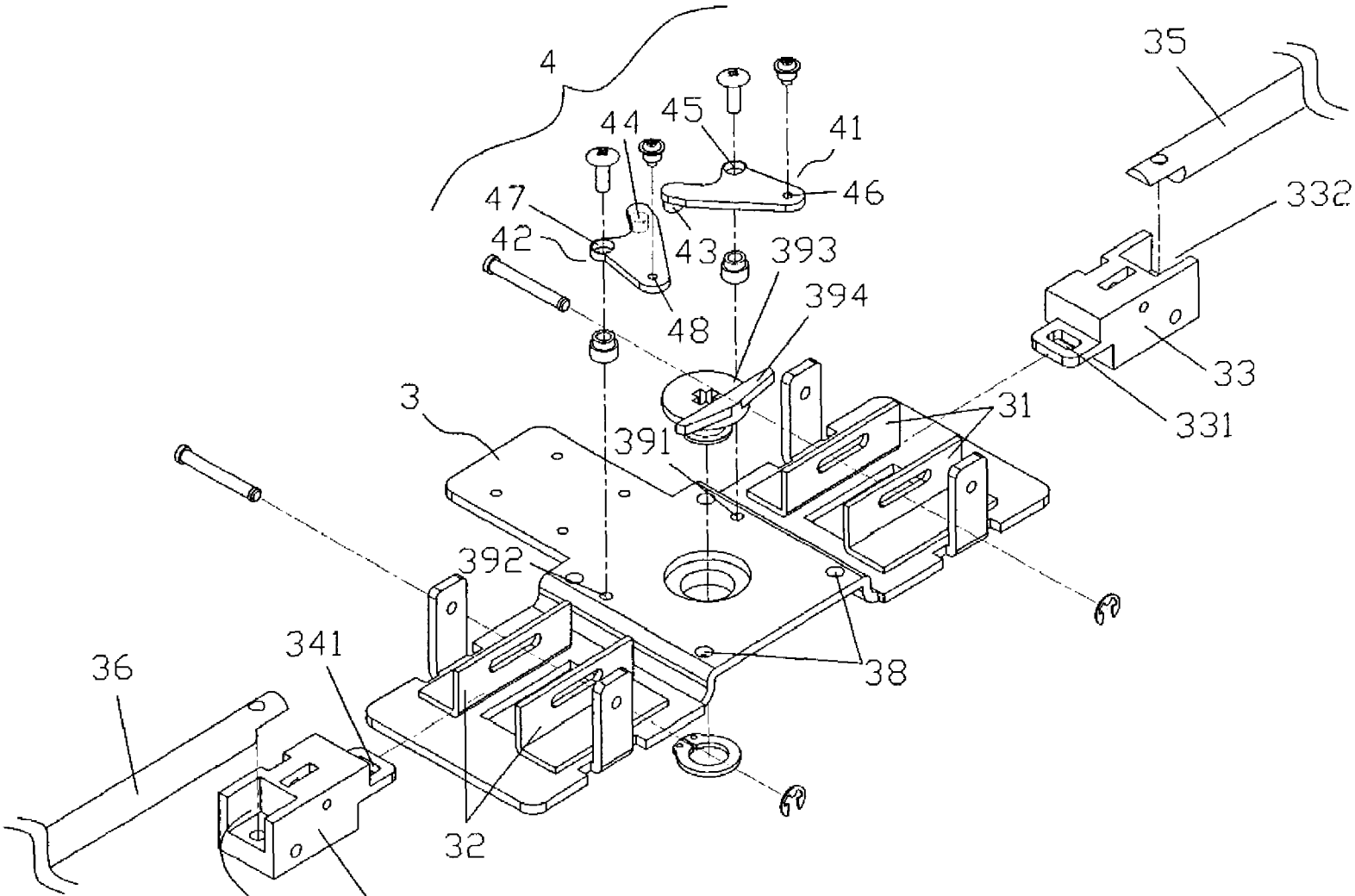
FIG. 3 is an exploded view of a base assembly of the fire door lock of the present invention.

With reference to the drawings and in particular to FIGS. 1-3, a fire door lock constructed in accordance with the present invention comprises a base assembly 2, which comprises a bottom plate 3 and first and second latch bars 35, 36. The bottom plate 3 forms at least one fixing hole 38 and two mounting holes 391, 392, which will be referred to as fifth and sixth mounting holes, respectively. The bottom plate 3 also forms first and second slide racks 31, 32 and comprises first and second slide blocks 33, 34, which are respectively and slidably received in the first and second slide racks 31, 32. The first slide block 33 forms a first notch 332 and a first slot 331 and similarly, the second slide block 34 forms a second notch 342 and a second slot 341. The first latch bar 35 is securely coupled to the first notch 332 of the first slide block 33, while the second latch bar 36 is securely coupled to the second notch 342 of the second slide block 34.

A winglet assembly 4 comprises first and second winglets 41, 42. The first winglet 41 forms first and second mounting holes 45, 46 and a first boss 43. The first mounting hole 45 is rotatably coupled to the fifth mounting hole 391 of the bottom plate 3 by a pivot (not labeled) and the second mounting hole 46 is rotatably coupled to the first slot 331 of the first slide block 33 by a pivot (not labeled). The second winglet 42 forms third and fourth mounting holes 47, 48 and a second boss 44. The third mounting hole 47 is rotatably coupled to the sixth mounting hole 392 of the bottom plate 3 by a pivot (not labeled) and the fourth mounting hole 8 is rotatably coupled to the second slot 341 of the second slide block 34.

Figure 4:
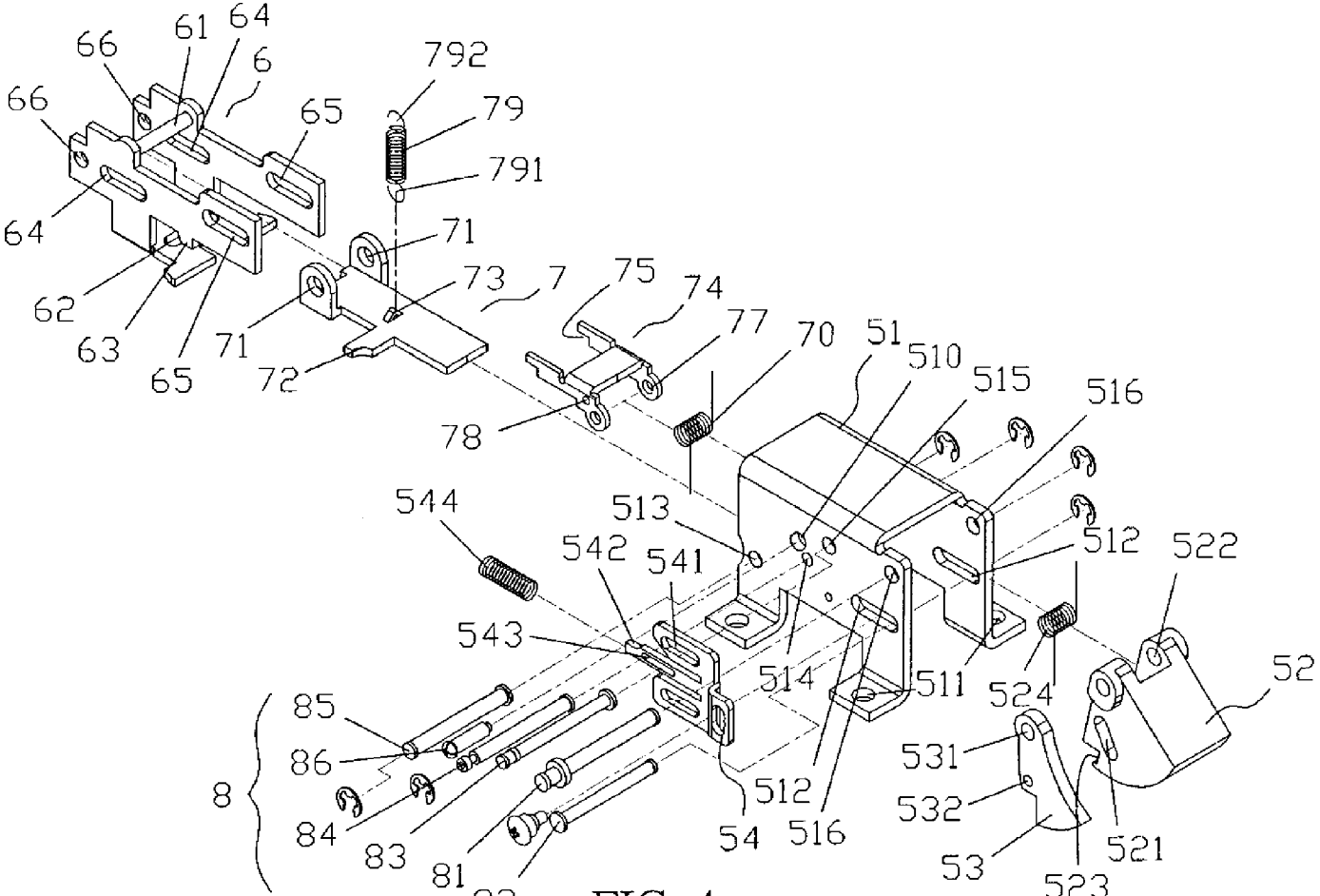
FIG. 4 is an exploded view of a locking control assembly of the fire door lock of the present invention.
Figure 5:
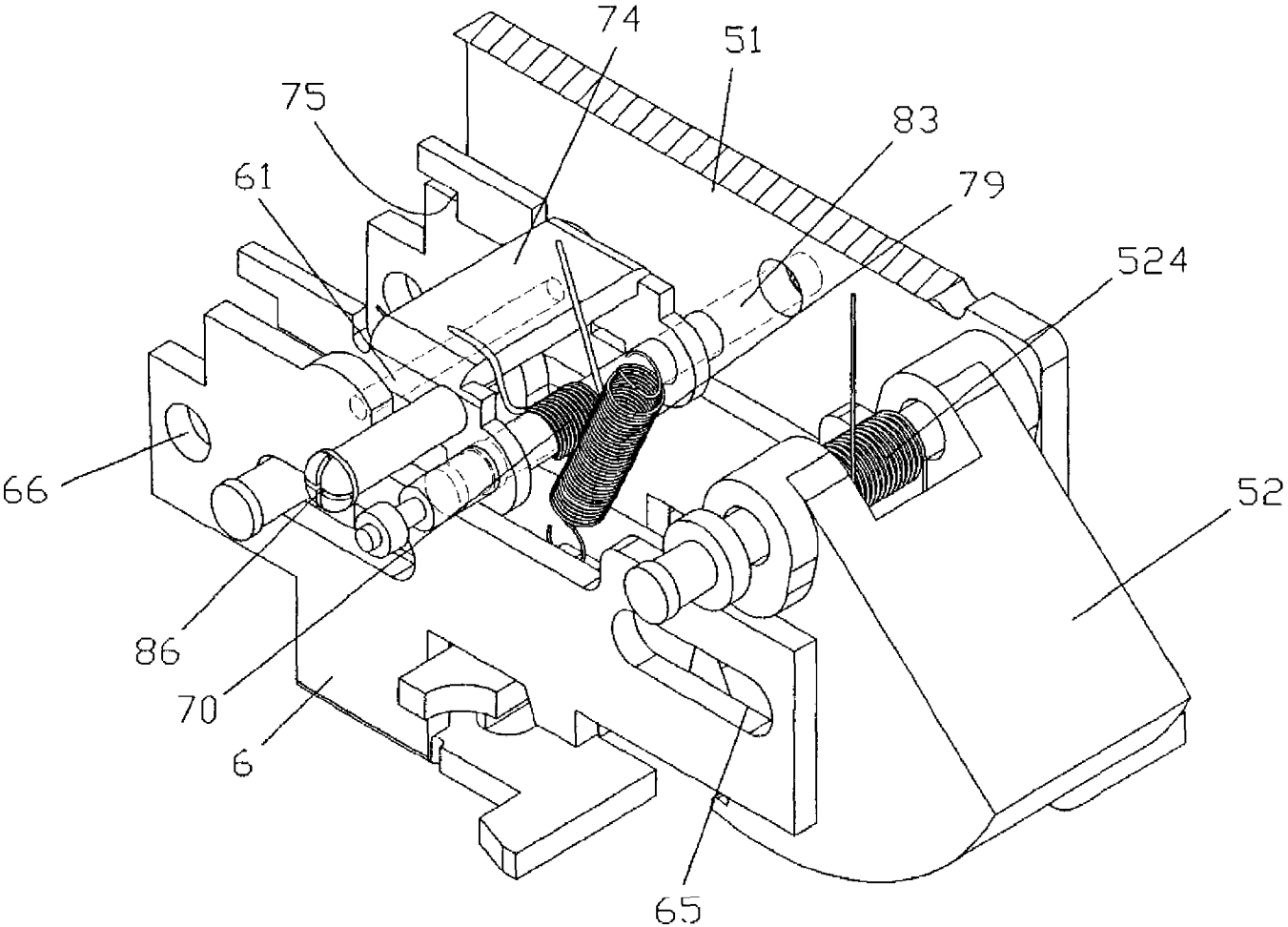
FIG. 5 is a perspective view, partially broken, of the locking control assembly of the fire door lock of the present invention.
Figure 13:
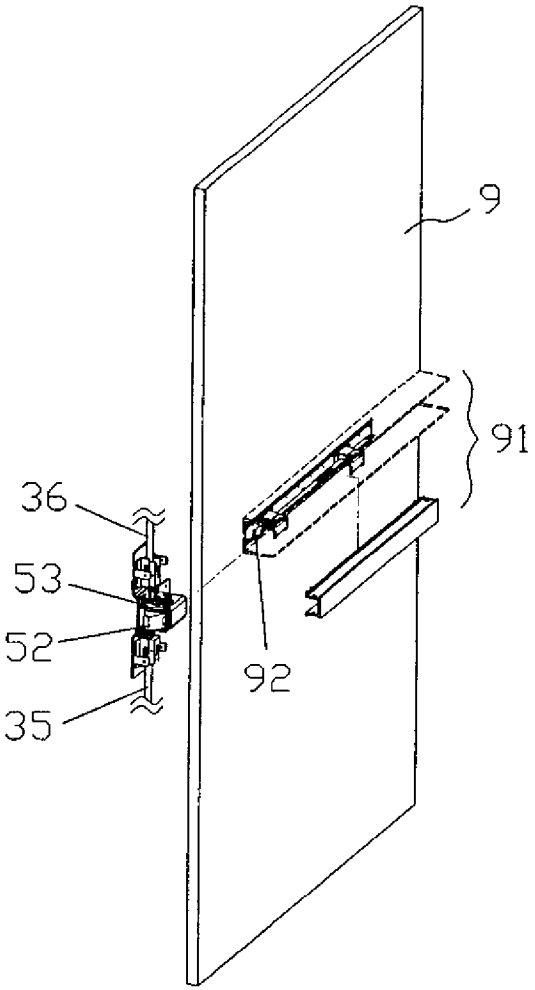
FIG. 13 is a perspective view illustrating the fire door lock of the present invention mounted to a fire door panel.

Also referring to FIGS. 2, 4 and 5, a locking control assembly 5 comprises a housing 51, a movable seat 6, a tongue holder seat 7, a holder 74 and a tongue 52, a tongue control plate 53, a control plate 54, and a shaft set 8 that is composed of a number of pins and shafts 81-85. The housing 51 forms at least one housing mounting hole 511, a control hole 510, a third elongated hole 512 and fourth, fifth, sixth, and seventh through-holes 513, 514, 515, 516. The movable seat 6 comprises a positioning bar 61, a first stop 63, a groove 62, and at least one through hole 66. The movable seat 6 has opposite side walls in which first elongated holes 64 and second elongated holes 65 are formed. The through holes 66 function to couple a connection end 92 of an operating handle assembly 91, as shown in FIG. 13. The tongue holder seat 7 comprises a second stop 72, first through holes 71, an anchoring hole 73, and a third spring 79. The holder 74 forms holding sections 75, a first aperture 78 and second trough holes 77. The tongue 52 forms a (recessed) engaging portion 523, a first bore 521, and second bores 522. The tongue control plate 53 has a third trough holes 531 and a second aperture 532. The control plate 54 comprises a fourth spring 544, a third stop 542, a fourth elongated hole 541, and a fifth elongated hole 543. The pivot set 8 comprises a control pin 86, a first shaft 81, a second shaft 82, a third shaft 83, a fourth shaft 84, and a fifth shaft 85.

Also referring to FIG. 13, which illustrates the fire door lock of the present invention mounted to a fire door panel 9, the connection end 92 of the operating handle assembly 91 is coupled to the trough holes 66 of the movable seat 6 so that when the operating handle assembly 91 is depressed or actuated, the first and second latch bard 35, 36 and the tongue 52 are moved to allow the fire door 9 to open. Further, when the fire door 9 is being closed the tongue control plate 53 is brought into contact with for example a door frame or a fixed article, the movable seat 6 is released to return to the original locked position whereby the first and second latch bars 35, 36 secure the fire door 9 and the tongue holder seat 7 is put in abutting engagement with the engaging portion 523 of the tongue 52 to thereby realize securing the fire door at three different orientations.

Figure 11:
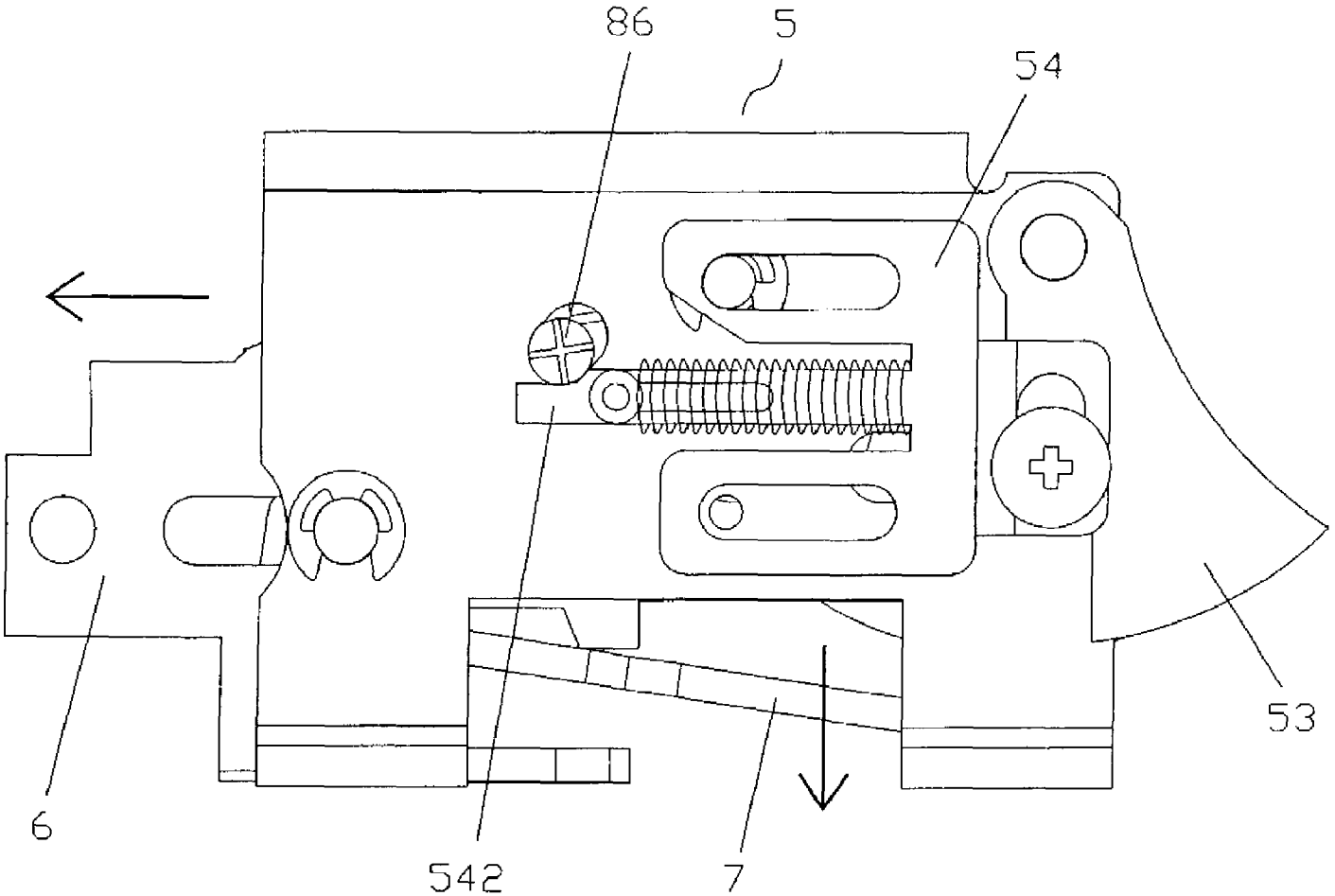
FIG. 11 is a side elevational view of the locking control assembly after the fire door lock is operated.
Figure 12:
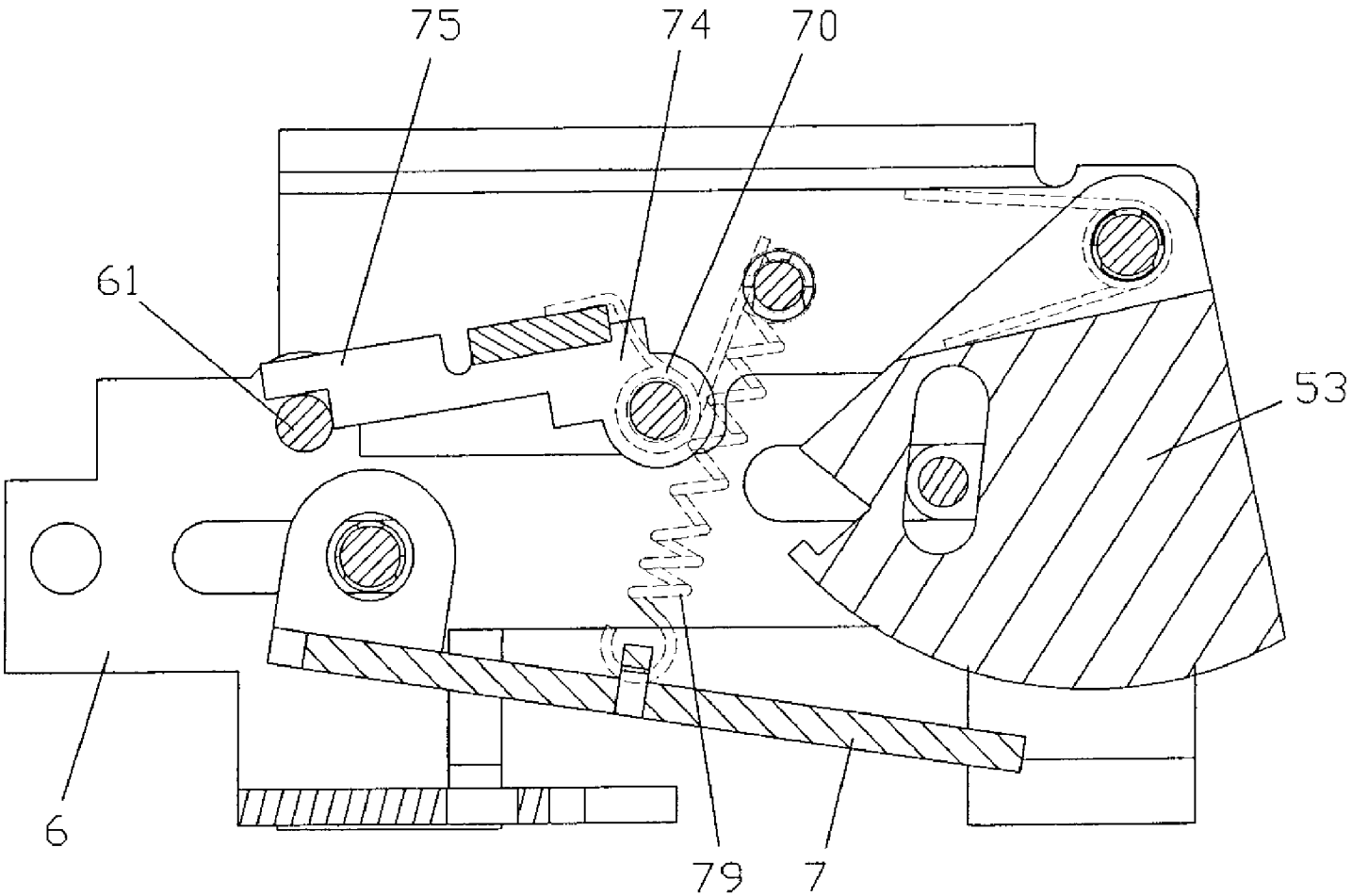
FIG. 12 is a cross-sectional view of the locking control assembly after the fire door lock is operated.

The first shaft 81 is received in the seventh through hole 516 of the housing 51 and is also rotatably fit into the third through hole 531 of the tongue control plate 53 and the second bores 522 of the tongue 52, and also extends through the first spring 524, which is a helical spring in the embodiment illustrated to thereby mount the tongue control plate 53, the tongue 52, and the first spring 524 in the housing 51. The second shaft 82 is movably received in the third elongated holes 512 of the housing 51 and is movably fit into the second elongated holes 65 of the movable seat 6 and the first bore 521 of the tongue 52 to thereby mount the movable seat 6 and the tongue 52 in the housing 51. Thus, when the movable seat 6 is moved in a rearward direction (that is a direction away from the tongue 52) by being actuated by the operating handle assembly 91, the tongue 52 is moved into the housing 51 and at the same time, the first stop 63 of the movable seat 6 depresses the second stop 72 of the tongue holder seat 7 downward (as illustrated in FIG. 11) due to a camming engagement therebetween to thereby release the abutting engagement between the tongue holder seat 7 and the engaging portion 523 of the tongue 52. By this, the tongue 52 is allowed to move inward into the housing 51 as demonstrated in FIG. 12. Further, the second spring 70 biases the holder 74 in such a way that the holding sections 75 of the holder 74 are moved into engagement with the positioning bar 61 of the movable seat 6 to prevent the movable seat 6 from moving forward and thereby maintaining an unlocked condition.

The fifth shaft 85 is received in the fourth through holes 513 of the housing 51 and is movably fit into the first elongated holes 64 of the movable seat 6 and rotatably fit into the first through holes 71 of the tongue holder seat 7 to thereby mount the movable seat 6 and the tongue holder seat 7 in the housing 51. The third shaft 83 is received in the sixth rough hole 515 of the housing 51 and is movably fit into the fourth elongated hole 541 of the control plate 54 to mount the control plate 54 to an outside surfaced of one side wall of the housing 51. The fourth shaft 84 is received in the fifth through holes 514 of the housing 51 and is rotatably fit in the second trough holes 77 of the holder 74 and also extends through the second spring 70 and the fifth elongated hole 543 of the control plate 54 to thereby mount the holder 74, the second spring 74, and the control plate 54 to the housing 51. The control pin 86 is fit into the control hole 510 of the housing 51 and is further fit into the first aperture 78 of the holder 74. The third spring 79 has an end 791 mounted to the anchoring hole 73 of the tongue holder seat 7 and an opposite end 792 attached to the third shaft 83.

Figure 6:
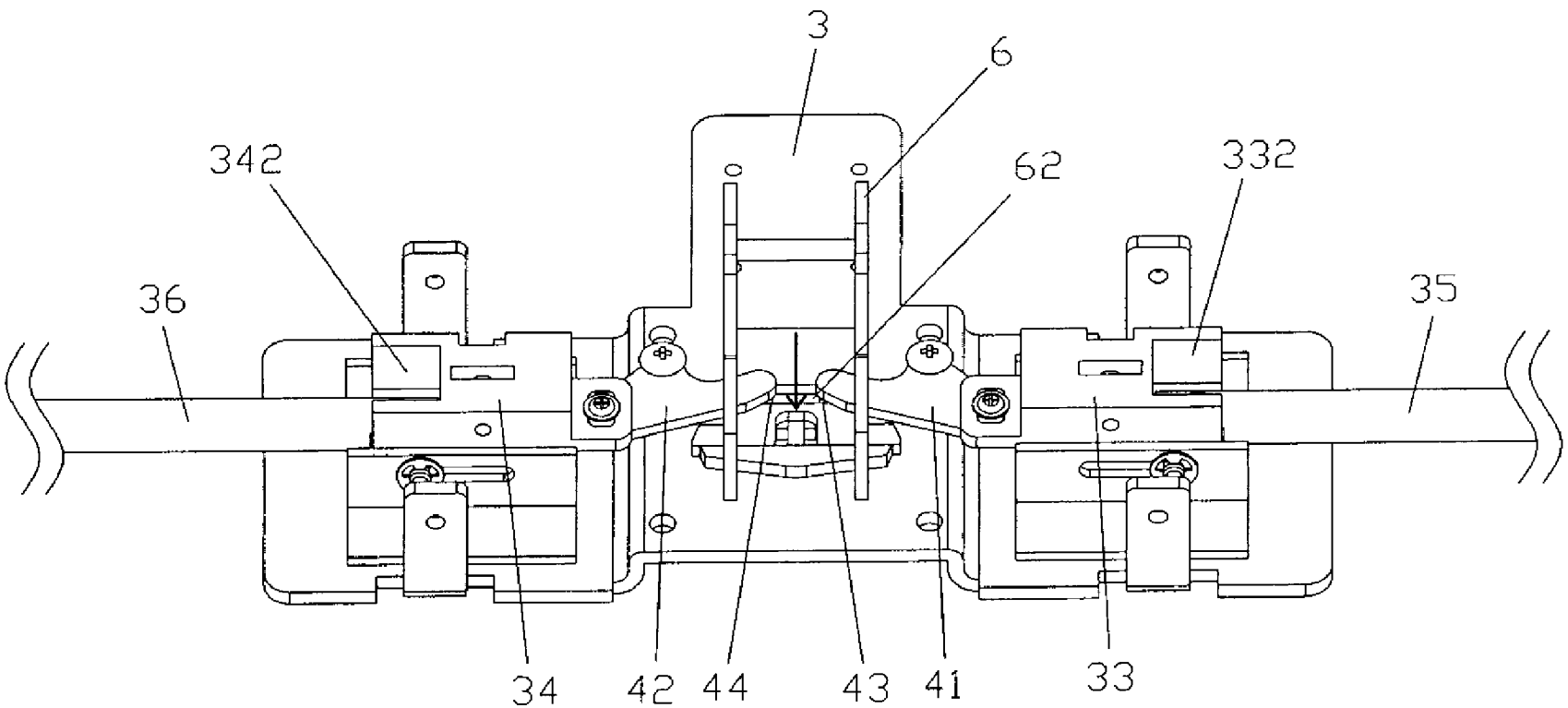
FIG. 6 is a schematic view illustrating the base assembly before the fire door lock is operated.
Figure 9:
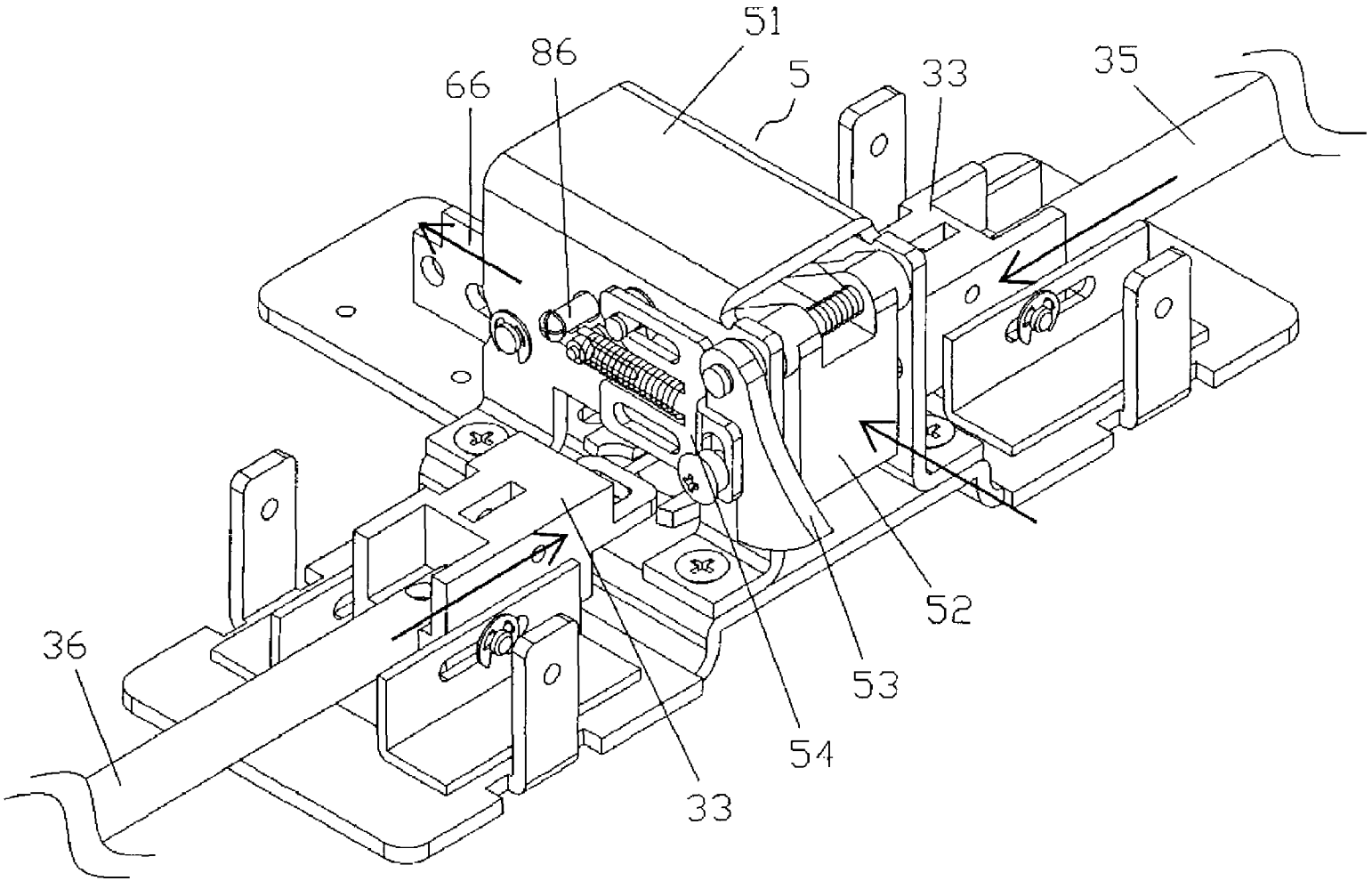
FIG. 9 is a perspective view illustrating the operation of the fire door lock of the present invention.
Figure 10:
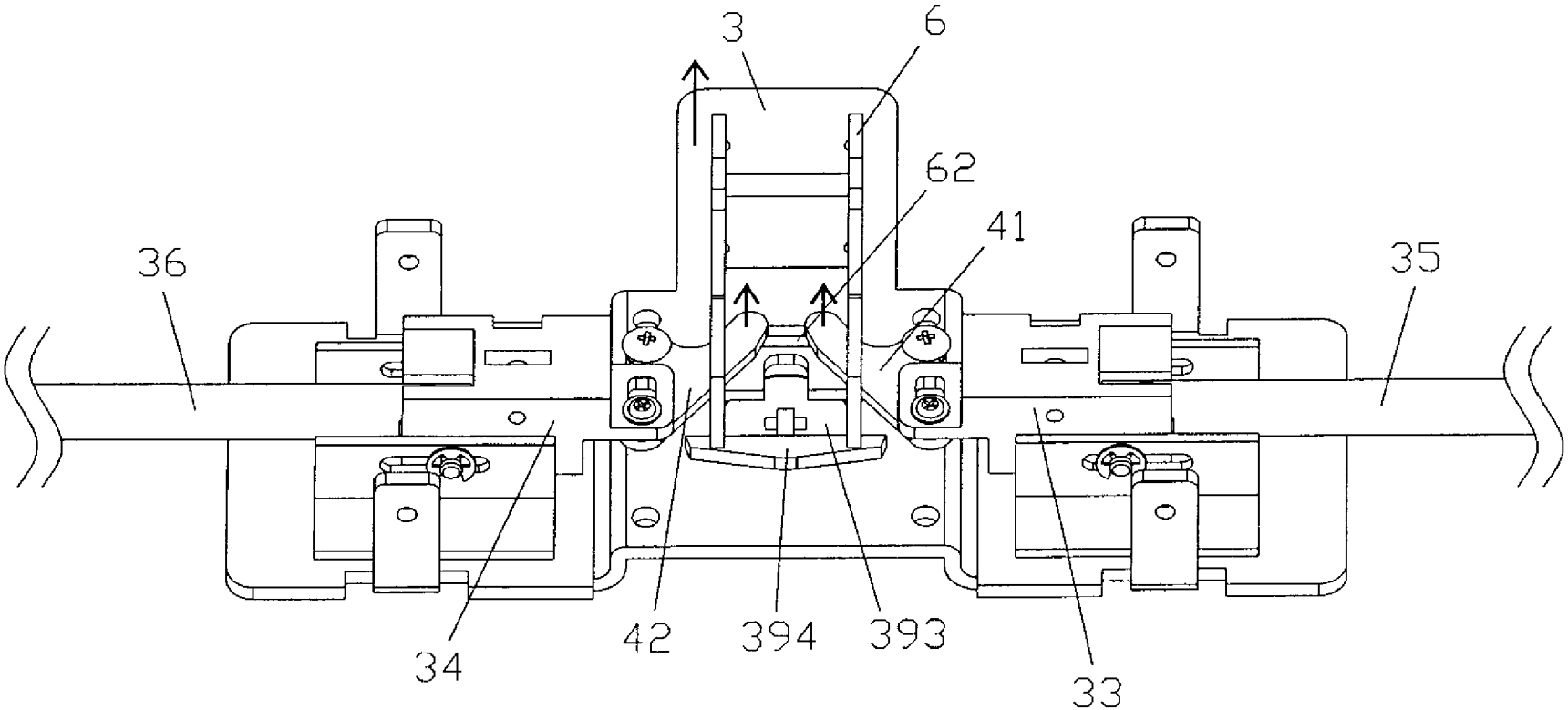
FIG. 10 is a schematic view illustrating the base assembly after the fire door lock is operated.

Also referring to FIGS. 3 and 6, the first boss 43 of the first winglet 41 and the second boss 44 of the second winglet 42 are received in the groove 62 of the movable seat 6. The first mounting hole 45 of the first winglet 41 is rotatably coupled to the fifth mounting hole 391 of the bottom plate 3 and the second mounting hole 46 of the first winglet 41 is rotatably and movably coupled to the first slot 331 of the first slide block 33. The third mounting hole 47 of the second winglet 47 is rotatably coupled to the sixth mounting hole 392 of the bottom plate 3 and the fourth mounting hole 48 of the second winglet 42 is movably and rotatably coupled to the second slot 341 of the second slide block 34. Thus, when the movable seat 6 is moved rearward, the first and second slide blocks 33, 34 are driven in a direction into the locking control assembly 5. And as shown in FIGS. 9 and 10, the first and second latch bars 35, 36 are also driven to release the fire door 9. Consequently, both latch bars 35, 36 and the tongue 52 are actuated or moved at the same time to release the fire door 9.

Figure 7:
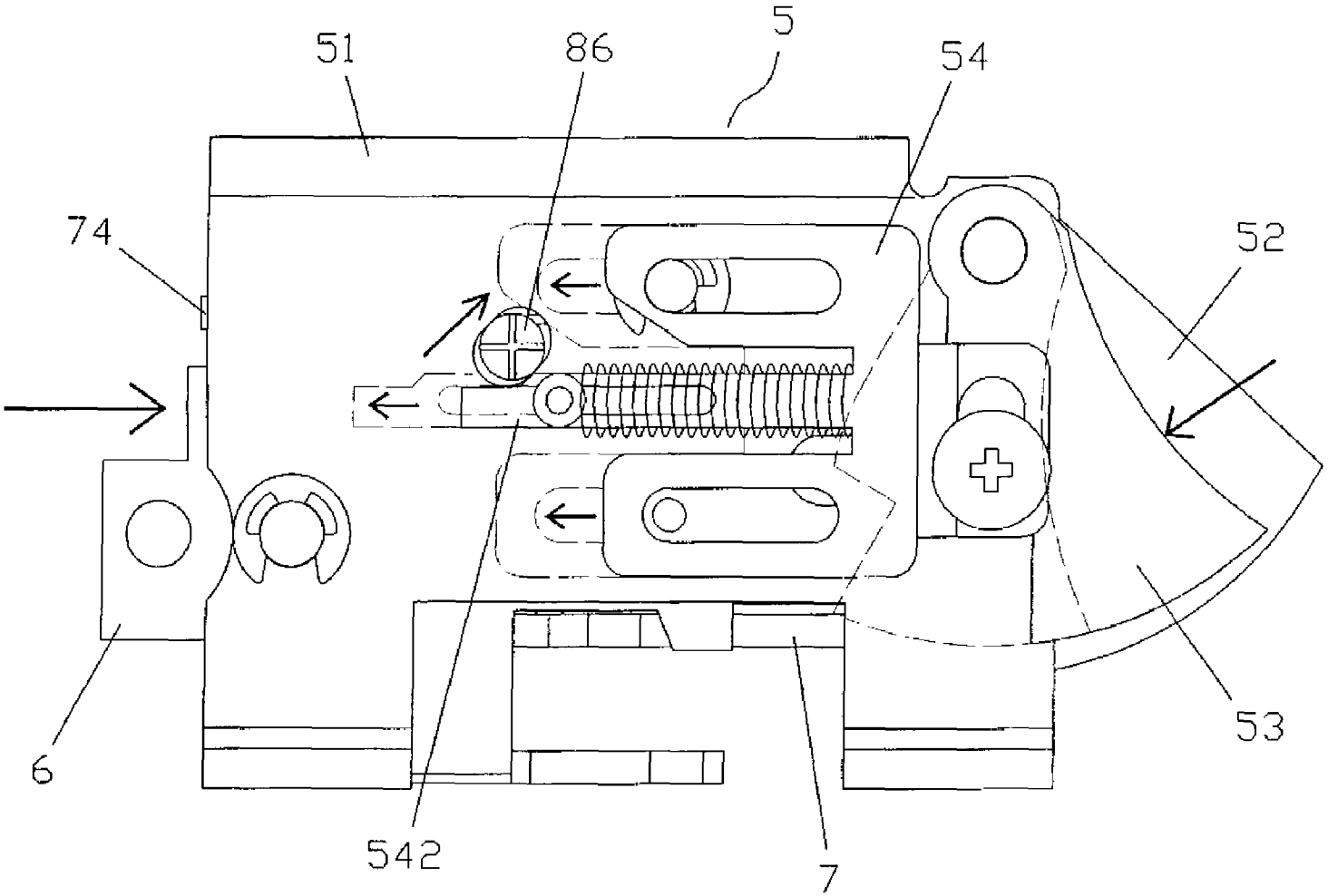
FIG. 7 is a side elevational view of the locking control assembly before the fire door lock is operated.
Figure 8:
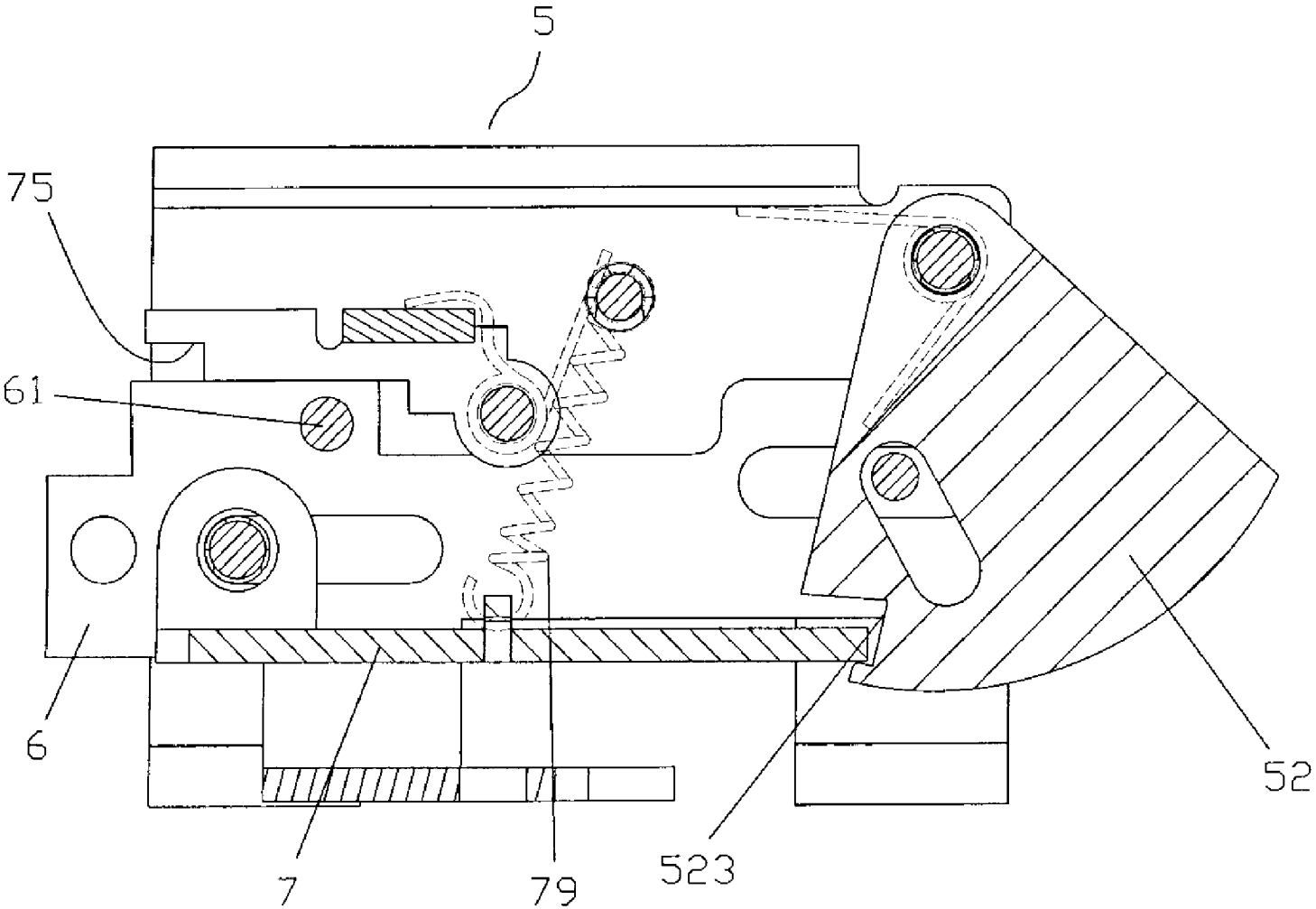
FIG. 8 is a cross-sectional view of the locking control assembly before the fire door lock is operated.

When the fire door 9 is closed again, as shown in FIGS. 5 and 7, the tongue control plate 53 that is movably arranged outside the housing 51 is brought into contact with and thus stopped by for example a door frame or an opposite door panel so that the control plate 54 is forced rearward, the third stop 542 of the control plate 54, due to camming action, raises the control pin 86 upward and simultaneously raises the holder 74 upward thereby releasing the engagement between the holding sections 75 of the holder 74 and the positioning bar 61 of the movable seat 6 to allow the movable seat 6 to return to the locked condition as being biased by a spring force of the third spring 79 that has the end 791 fixed to the anchoring hole 73 of the tongue holder seat 7 and the opposite end 792 attached to the third shaft 83, as shown in FIGS. 5 and 8. In this condition, the tongue holder seat 7 is again positioned in engagement with the recessed engaging portion 523 of the tongue 52 and at the same time, the tongue 52 is biased outward by the first spring 524, to thereby make and maintain the tongue 52 in the locked condition.

In addition, as shown in FIG. 2, the bottom plate 3 is provided with a lock portion 393, which comprises a switching block 394 so that when the lock portion 393 is operated with a key for opening the fire door lock, the switching block 394 is rotated and thus moving the movable seat 6, as shown in FIG. 10, thereby realizing opening of the fire door with a key. Since the lock portion 393 is known in the art and constitutes no novel part of the invention, no detail will be given herein.

Although the present invention has been described with reference to the preferred embodiment thereof, it is apparent to those skilled in the art that a variety of modifications and changes may be made without departing from the scope of the present invention which is intended to be defined by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A fire door lock comprising:

a base assembly comprising a bottom plate and first and second latch bars, the bottom plate having at least one fixing hole, a first mounting hole and a second mounting hole, the bottom plate also having first and second slide racks and first and second slide blocks which are respectively and slidably received in the first and second slide racks, the first slide block having a first notch and a first slot, the second slide block having a second notch and a second slot, the first latch bar being securely coupled to the first notch of the first slide block while the second latch bar being securely coupled to the second notch of the second slide block;

a locking control assembly comprising a housing, a movable seat, a tongue holder seat, a holder and a tongue, a tongue control plate, a control plate, and a shaft set that is composed of a number of pins and shafts, the housing having at least one housing mounting hole, a control hole, a first elongated hole and first, second, third and fourth through holes, the movable seat having a positioning bar, a first stop, a groove, and at least one through hole, the movable seat having opposite side walls in each of which a second elongated hole and a third elongated hole are formed, the through hole of the movable seat being coupled to a connection end of an operating handle assembly, the tongue holder seat having a second stop, two through holes, an anchoring hole, and a first spring, the holder having two holding sections, a first aperture and two through holes, the tongue having an engaging portion, a first bore, and two second bores, the tongue control plate having two through holes and a second aperture, the control plate having a second spring, a third stop, a fourth elongated hole, and a fifth elongated hole, the pivot set having a control pin and a first shaft, a second shaft, a third shaft, a fourth shaft, and a fifth shaft, the first shaft extending through the first through hole of the housing and the first bore of the tongue and the through hole of the tongue control plate, the third shaft extending through the second through hole of the housing and the through hole of the holder, and the fifth shaft extending through the third through hole of the housing and the first elongated hole of the movable seat and the through hole of the tongue holder seat;

a winglet assembly comprising first and second winglets, the first winglet having first and second mounting holes and a first boss, the first mounting hole of the first winglet being rotatably coupled to the first mounting hole of the bottom plate by a pivot, the second mounting hole of the first winglet being rotatably coupled to the first slot of the first slide block by a pivot, the second winglet having third and fourth mounting holes and a second boss, the third mounting hole of the second winglet being rotatably coupled to the second mounting hole of the bottom plate by a pivot and the fourth mounting hole of the second winglet being rotatably coupled to the second slot of the second slide block; the first and second bosses being received in and coupled to the movable seat.

2. The fire door lock as claimed in claim 1, wherein the base assembly comprises a lock portion, which comprises a switching block.

3. The fire door lock as claimed in claim 1, wherein the engaging portion is recessed in the tongue.

4. The fire door lock as claimed in claim 1, wherein the third stop of the control plate has an inclined edge.

* * * * *